US009032950B2

(12) United States Patent
Schultz

(10) Patent No.: US 9,032,950 B2
(45) Date of Patent: May 19, 2015

(54) GAS PRESSURE CONTROL FOR WARM AIR FURNACES

(75) Inventor: Michael W. Schultz, Elk River, MN (US)

(73) Assignee: Honeywell International Inc., Morristown, NJ (US)

( * ) Notice: Subject to any disclaimer, the term of this patent is extended or adjusted under 35 U.S.C. 154(b) by 556 days.

(21) Appl. No.: 13/178,304

(22) Filed: Jul. 7, 2011

(65) Prior Publication Data

US 2011/0269082 A1 Nov. 3, 2011

Related U.S. Application Data

(63) Continuation of application No. 11/550,619, filed on Oct. 18, 2006, now abandoned.

(51) Int. Cl.

| | |
|---|---|
| ***F24H 9/20*** | (2006.01) |
| ***F23N 1/02*** | (2006.01) |
| ***F23N 5/20*** | (2006.01) |
| *F23N 5/10* | (2006.01) |
| *F23N 5/18* | (2006.01) |

(52) U.S. Cl.

CPC . *F23N 1/022* (2013.01); *F23N 5/10* (2013.01); *F23N 5/203* (2013.01); *F23N 2005/181* (2013.01); *F23N 2033/04* (2013.01); *F23N 2041/02* (2013.01)

(58) Field of Classification Search

CPC ..... F24H 9/20; F24H 3/06
USPC ..... 126/116 R, 116 A; 236/1 E, 1 EB, 1 EA; 431/12, 18, 89, 90, 19
See application file for complete search history.

(56) References Cited

U.S. PATENT DOCUMENTS

| | | | |
|---|---|---|---|
| 2,811,166 | A | 10/1957 | Collins et al. |
| 3,630,496 | A | 12/1971 | Hurst |
| 3,685,945 | A | 8/1972 | Good |
| 4,202,760 | A | 5/1980 | Storey et al. |

(Continued)

FOREIGN PATENT DOCUMENTS

| | | |
|---|---|---|
| EP | 1843095 | 10/2007 |
| JP | 57153120 | 9/1982 |

(Continued)

OTHER PUBLICATIONS

All Foreign and NPL References Were Previously Cited in Parent U.S. Appl. No. 11/550,619, filed October 18, 2006.

(Continued)

*Primary Examiner* — Gregory Huson
*Assistant Examiner* — Nikhil Mashruwala
(74) *Attorney, Agent, or Firm* — Seager, Tufte & Wickhem LLC

(57) ABSTRACT

Systems, methods, and controllers for controlling gas-fired appliances such as warm air furnaces are disclosed. An illustrative furnace system can include a burner unit in communication with a combustion air flow conduit and heat exchanger, a variable speed inducer fan or blower adapted to provide a flow of combustion air to the burner unit, a furnace controller and motor speed control unit adapted to regulate the speed of the inducer fan or blower, and a pneumatically modulated gas valve adapted to variably output gas pressure to the burner unit based at least in part on the combustion air flow.

18 Claims, 7 Drawing Sheets

(56) References Cited

U.S. PATENT DOCUMENTS

| | | | | |
|---|---|---|---|---|
| 4,251,025 | A | 2/1981 | Bonne et al. | |
| 4,314,441 | A | 2/1982 | Yannone et al. | |
| 4,329,138 | A | 5/1982 | Riordan | |
| 4,334,855 | A | 6/1982 | Nelson | |
| 4,340,355 | A | 7/1982 | Nelson et al. | |
| 4,373,897 | A | 2/1983 | Torborg | |
| 4,439,139 | A | 3/1984 | Nelson et al. | |
| 4,483,672 | A | 11/1984 | Wallace et al. | |
| 4,502,625 | A | 3/1985 | Mueller | |
| 4,533,315 | A | 8/1985 | Nelson | |
| 4,585,161 | A | 4/1986 | Kusama et al. | |
| 4,586,893 | A | 5/1986 | Somerville et al. | |
| 4,613,072 | A | 9/1986 | Kikuchi et al. | |
| 4,626,194 | A | 12/1986 | Mills | |
| 4,688,547 | A | 8/1987 | Ballard et al. | |
| 4,703,795 | A | 11/1987 | Beckey | |
| 4,708,636 | A | 11/1987 | Johnson | |
| 4,729,207 | A | 3/1988 | Dempsey et al. | |
| 4,767,104 | A | 8/1988 | Plesinger | |
| 4,789,330 | A | 12/1988 | Ballard et al. | |
| 4,819,587 | A | 4/1989 | Tsutsui et al. | |
| 4,850,853 | A | 7/1989 | Gruber et al. | |
| 4,864,060 | A | 9/1989 | Karalis et al. | |
| 4,892,245 | A | 1/1990 | Dunaway et al. | |
| 4,915,615 | A | 4/1990 | Kawamura et al. | |
| 5,002,484 | A | 3/1991 | Lofton et al. | |
| 5,026,270 | A | 6/1991 | Adams et al. | |
| 5,027,789 | A * | 7/1991 | Lynch | 126/116 A |
| 5,039,006 | A | 8/1991 | Habegger | |
| 5,197,664 | A | 3/1993 | Lynch | |
| 5,248,083 | A | 9/1993 | Adams et al. | |
| 5,307,990 | A | 5/1994 | Adams et al. | |
| 5,331,944 | A | 7/1994 | Kujawa et al. | |
| 5,340,028 | A | 8/1994 | Thompson | |
| 5,347,981 | A | 9/1994 | Southern et al. | |
| 5,408,986 | A | 4/1995 | Bigham | |
| 5,415,143 | A | 5/1995 | Togai | |
| 5,513,979 | A * | 5/1996 | Pallek et al. | 431/90 |
| 5,520,533 | A | 5/1996 | Vrolijk | |
| 5,570,659 | A | 11/1996 | Cohen | |
| 5,590,642 | A | 1/1997 | Borgeson et al. | |
| 5,630,408 | A | 5/1997 | Versluis | |
| 5,676,069 | A | 10/1997 | Hollenbeck | |
| 5,682,826 | A * | 11/1997 | Hollenbeck | 110/147 |
| 5,720,231 | A | 2/1998 | Rowlette et al. | |
| 5,730,069 | A | 3/1998 | Coolidge et al. | |
| 5,732,691 | A | 3/1998 | Maiello et al. | |
| 5,791,332 | A | 8/1998 | Thompson et al. | |
| 5,806,440 | A | 9/1998 | Rowlette et al. | |
| 5,819,721 | A | 10/1998 | Carr et al. | |
| 5,860,411 | A | 1/1999 | Thompson et al. | |
| 5,865,611 | A | 2/1999 | Maiello | |
| 5,878,741 | A | 3/1999 | Dempsey et al. | |
| 5,980,528 | A | 11/1999 | Salys | |
| 5,993,195 | A | 11/1999 | Thompson | |
| 6,000,622 | A | 12/1999 | Tonner et al. | |
| 6,109,255 | A | 8/2000 | Dieckmann et al. | |
| 6,254,008 | B1 | 7/2001 | Erickson et al. | |
| 6,257,870 | B1 | 7/2001 | Hugghins et al. | |
| 6,283,115 | B1 | 9/2001 | Dempsey et al. | |
| 6,295,937 | B1 | 10/2001 | Nakanishi et al. | |
| 6,321,744 | B1 | 11/2001 | Dempsey et al. | |
| 6,327,980 | B1 | 12/2001 | Chen et al. | |
| 6,354,327 | B1 | 3/2002 | Mayhew | |
| 6,377,426 | B2 | 4/2002 | Hugghins et al. | |
| 6,504,338 | B1 | 1/2003 | Eichorn | |
| 6,571,817 | B1 | 6/2003 | Bohan, Jr. | |
| 6,579,087 | B1 | 6/2003 | Vrolijk | |
| 6,705,533 | B2 | 3/2004 | Casey et al. | |
| 6,749,423 | B2 | 6/2004 | Fredricks et al. | |
| 6,758,909 | B2 | 7/2004 | Jonnalagadda et al. | |
| 6,764,298 | B2 | 7/2004 | Kim et al. | |
| 6,770,141 | B1 | 8/2004 | Campbell et al. | |
| 6,793,015 | B1 | 9/2004 | Brown et al. | |
| 6,846,514 | B2 | 1/2005 | Jonnalagadda et al. | |
| 6,866,202 | B2 | 3/2005 | Sigafus et al. | |
| 6,880,548 | B2 | 4/2005 | Schultz et al. | |
| 6,918,756 | B2 | 7/2005 | Fredricks et al. | |
| 6,923,643 | B2 | 8/2005 | Schultz et al. | |
| 6,925,999 | B2 | 8/2005 | Hugghins et al. | |
| 6,984,122 | B2 | 1/2006 | Sullivan et al. | |
| 7,055,759 | B2 | 6/2006 | Wacker et al. | |
| 7,073,365 | B2 | 7/2006 | Geho et al. | |
| 7,101,172 | B2 | 9/2006 | Jaeschke | |
| 7,111,503 | B2 | 9/2006 | Brumboiu et al. | |
| 7,241,135 | B2 | 7/2007 | Munsterhuis et al. | |
| 7,293,718 | B2 * | 11/2007 | Sigafus et al. | 236/11 |
| 7,523,762 | B2 | 4/2009 | Buezis et al. | |
| 7,735,743 | B2 | 6/2010 | Jaeschke | |
| 7,748,375 | B2 | 7/2010 | Schultz | |
| 7,802,984 | B2 * | 9/2010 | Specht | 431/89 |
| 2002/0155405 | A1 | 10/2002 | Casey et al. | |
| 2008/0124667 | A1 | 5/2008 | Schultz | |
| 2008/0124668 | A1 | 5/2008 | Schultz et al. | |
| 2008/0213710 | A1 | 9/2008 | Schultz et al. | |
| 2009/0158746 | A1 | 6/2009 | Nuding et al. | |
| 2009/0308372 | A1 * | 12/2009 | Nordberg et al. | 126/116 A |
| 2011/0100349 | A1 * | 5/2011 | Hugghins | 126/116 A |

FOREIGN PATENT DOCUMENTS

| | | |
|---|---|---|
| JP | 6170340 | 4/1986 |
| JP | 367918 | 3/1991 |
| JP | 4327713 | 11/1992 |
| JP | 6281258 | 10/1994 |
| JP | 8261446 | 10/1996 |
| JP | 8313061 | 11/1996 |
| JP | 11198644 | 7/1999 |

OTHER PUBLICATIONS

Honeywell, VK41..R/VK81..R Series, Gas Controls With Integrated Gas/Air Module for Combined Valve and Ignition System, pp. 1-6, prior to Oct. 18, 2006.

Honeywell, 45.801.175-, Amplification Gas/Air Module for VK4105R/VK8105R Gas Controls, pp. 1-8, prior to Oct. 18, 2006.

http://www.regal-beloit.com/gedrafthtml, Welcom to GE Commercial Motors by Regal-Beloit, 1 page, printed Apr. 26, 2006.

Lennox, "G61MPV Series Units," Installation Instructions, 2 pages, Oct. 2006.

Prosecution Documents for U.S. Appl. No. 11/550,775, filed Oct. 18, 2006.

* cited by examiner

GAS PRESSURE CONTROL FOR WARM AIR FURNACES

The present application is a continuation of U.S. patent application Ser. No. 11/550,619, filed Oct. 18, 2006, now abandoned entitled "Gas Pressure Control For Warm Air Furnaces", which is hereby incorporated by reference.

FIELD

The present invention relates generally to the field of gas-fired appliances. More specifically, the present invention pertains to systems, methods, and controllers for regulating gas pressure to gas-fired appliances such as warm air furnaces.

BACKGROUND

Warm air furnaces are frequently used in homes and office buildings to heat intake air received through return ducts and distribute heated air through warm air supply ducts. Such furnaces typically include a circulation fan or blower that directs cold air from the return ducts across a heat exchanger having metal surfaces that act to heat the air to an elevated temperature. An ignition element such as an AC hot surface ignition (HSI) element or direct spark igniter may be provided as part of a gas burner unit for heating the metal surfaces of the heat exchanger. The air heated by the heat exchanger can be discharged into the warm air ducts via the circulation fan or blower, which produces a positive airflow within the ducts. In some designs, a separate inducer fan or blower can be used to remove exhaust gasses resulting from the combustion process through an exhaust vent.

In a conventional warm air furnace system, gas valves are typically used to regulate gas pressure supplied to the burner unit at specific limits established by the manufacturer and/or by industry standard. Such gas valves can be used, for example, to establish an upper gas flow limit to prevent over-combustion or fuel-rich combustion within the appliance, or to establish a lower limit to prevent combustion when the supply of gas is insufficient to permit proper operation of the appliance. In some cases, the gas valve regulates gas pressure independent of the inducer fan. This may permit the inducer fan to be overdriven to overcome a blocked vent or to compensate for pressure drops due to long vent lengths without exceeding the maximum firing rate of the appliance.

In some designs, the gas valve may be used to modulate the gas firing rate within a particular range in order to vary the amount of heating provided by the appliance. Modulation of the gas firing rate may be accomplished, for example, via pneumatic signals received from the inducer fan, or via electrical signals from a controller tasked to control the gas valve. While such techniques are generally capable of modulating the gas firing rate, such modulation is usually accomplished via control signals that are independent from the control of the combustion air flow produced by the inducer fan. In some two-stage furnaces, for example, the gas valve may output gas pressure at two different firing rates based on control signals that are independent of the actual combustion air flow produced by the inducer fan. Since the gas control is usually separate from the combustion air control, the delivery of a constant gas/air mixture to the burner unit may be difficult or infeasible over the entire range of firing rate.

In some systems, supply air temperature and pressure sensors are employed to sense the combustion air flow produced by the inducer fan. Typically, the temperature and pressure sensors will sense the supply air fed to the burner box, which can then be used by the controller to compute mass flow through the combustion side of the furnace. In some designs, a mass flow sensor may also be used in lieu of, the temperature and pressure sensors to compute mass flow.

The addition of these sensors require additional power to operate the furnace, decreasing overall power efficiency. In some cases, the performance of these sensors can degrade over time, causing the furnace to operate at a lower efficiency or to shut-down due to a system fault. The complexity associated with installing these sensors can also increase the level of skill and time required to install and service the furnace system.

SUMMARY

The present invention pertains to systems, methods, and controllers for controlling gas-fired appliances such as warm air furnaces. A furnace system in accordance with an illustrative embodiment can include a burner unit in communication with a combustion air flow conduit and heat exchanger, a variable speed inducer fan or blower adapted to provide combustion air flow to the burner unit, a furnace controller and motor speed control unit adapted to regulate the speed of the fan or blower, and a pneumatically modulated gas valve adapted to variably output gas pressure to the burner unit based at least in part on the combustion air flow.

The furnace controller can include a processor adapted to compute the combustion mass air flow at the burner unit, and a motor speed control unit adapted to regulate the speed of the fan or blower based at least in part on the computed air mass flow. In some embodiments, the motor speed control unit can comprise a separate unit from the furnace controller. In other embodiments, the motor speed control unit can be a part of the furnace controller. During operation, the furnace controller can be configured to receive heat demand signals from one or more thermostats that can be utilized by the motor speed control unit to either increase or decrease the combustion air flow in order to modulate the gas valve.

An illustrative method of controlling the gas-fired appliance can include the steps of receiving a heat request signal and activating the inducer fan or blower to produce a combustion air flow at the burner unit. Once the combustion air flow is initiated, the gas valve can be activated to provide fuel to the burner unit, which can then be ignited via an ignition element. To modulate the gas pressure fed to the burner unit, the speed of the inducer fan or blower can be adjusted based on the heat request signals. During operation, the rotational speed of the inducer fan or blower can be sensed via a sensor or switch, or alternatively the voltage or current to the inducer fan or blower motor can be measured in order to determine the supply air mass flow. Using the computed supply air mass flow, the speed of the inducer fan or blower can then be adjusted upwardly or downwardly in order to modulate the gas pressure outputted by the gas valve.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of furnace systems methods, and controllers are illustrated in the various views, those skilled in the art will recognize that many of the examples provided have suitable alternatives that can be utilized. While the furnace systems and methods are described with respect to warm air furnaces, it should be understood that the systems and methods described herein could be applied to the control of other gas-fired appliances, if desired. Examples of other gas-fired appliances that can be controlled can include, but are not limited to, water heaters, fireplace inserts, gas stoves, gas clothes dryers, gas grills, or any other such device where gas control is desired. Typically, such appliances utilize fuels such as natural gas or liquid propane gas as the primary fuel source, although other liquid and/or gas fuel sources may be provided depending on the type of appliance to be controlled.

Figure 1:
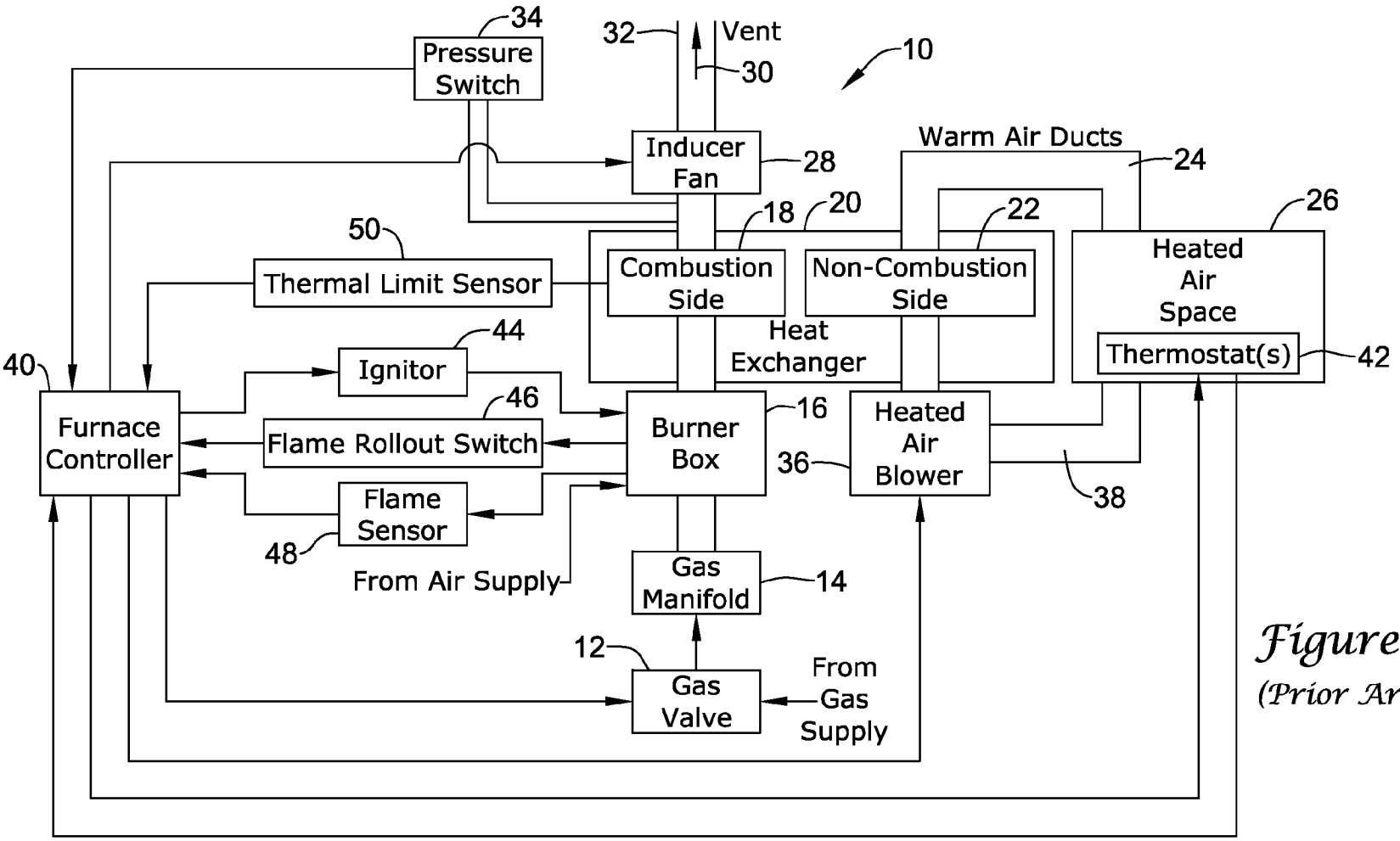
Figure 1 (Prior Art)
FIG. 1 is a diagrammatic view showing a conventional warm air furnace system.

Referring now to FIG. 1, a diagrammatic view showing a conventional warm air furnace (WAF) system 10 will now be described. As shown in FIG. 1, gas supplied via a gas valve 12 is fed to a gas manifold 14, which distributes gas to the burners of a burner box 16. Combusted air discharged from the burner box 16 can then be fed to the combustion side 18 of a heat exchanger 20, which transfers heat to a second side 22 for heating the warm air ducts 24 of a heated air space 26 such as a home or office building. An inducer fan or blower 28 coupled to the combustion side 18 of the heat exchanger 20 can be configured to draw in air through an air supply (e.g. an intake vent), which can be used for the combustion of fuel within the burner box 12. As indicated by arrow 30, the combustion air discharged from the heat exchanger 20 can then be exhausted via an exhaust vent 32.

The inducer fan 28 can be configured to produce a positive airflow through the heat exchanger 20 forcing the combusted air within the burner box 16 to be discharged through the exhaust vent 28. A pressure switch 34 can be attached to the combustion side of the heat exchanger 20 at the input of the inducer fan 28 to sense the pressure of combustion air flow present on the combustion side of the furnace. The pressure signals from the pressure switch 34 can be fed to a controller 40 that can be used to enable the gas valve 12 and initiate ignition.

On the non-combustion side 22 of the heat exchanger 20, a heated air blower or fan 36 blows heated air through a separate path in the heat exchanger 20 into the warm air ducts 24, the heated air space 26, and back through cold air return ducts 38. One or more thermostats 42 located in the heated air space 26 may provide input back to the controller 40. The feedback from the thermostats 42 may be in the form of temperature set-points inputted by an occupant of the space 26.

During operation, a supply of gas can be fed to the gas valve 12, which, in turn, outputs a metered gas pressure to the gas manifold 14 for combustion in the burner box 16. The fuel fed to the burner box 16 can then be ignited via an AC hot surface ignition element, direct spark igniter, or other suitable ignition element 44. A flame sensor 48 can be employed to provide an indication when a flame is present. The flame sensor 48 signals and signals from a flame rollout switch 46 can be inputted to the controller 40, which can be configured to shut down the gas valve 12 upon the occurrence of a fault condition. A thermal limit sensor 50 can be used to sense the temperature within the heat exchanger 20, which can be used by the controller 40 to shut down or limit the gas supplied to the burner box 16 via the gas valve 12 or to change the speed of the inducer fan 28 or heated air blower 36 in order to reduce the heat exchanger temperature.

Figure 2:
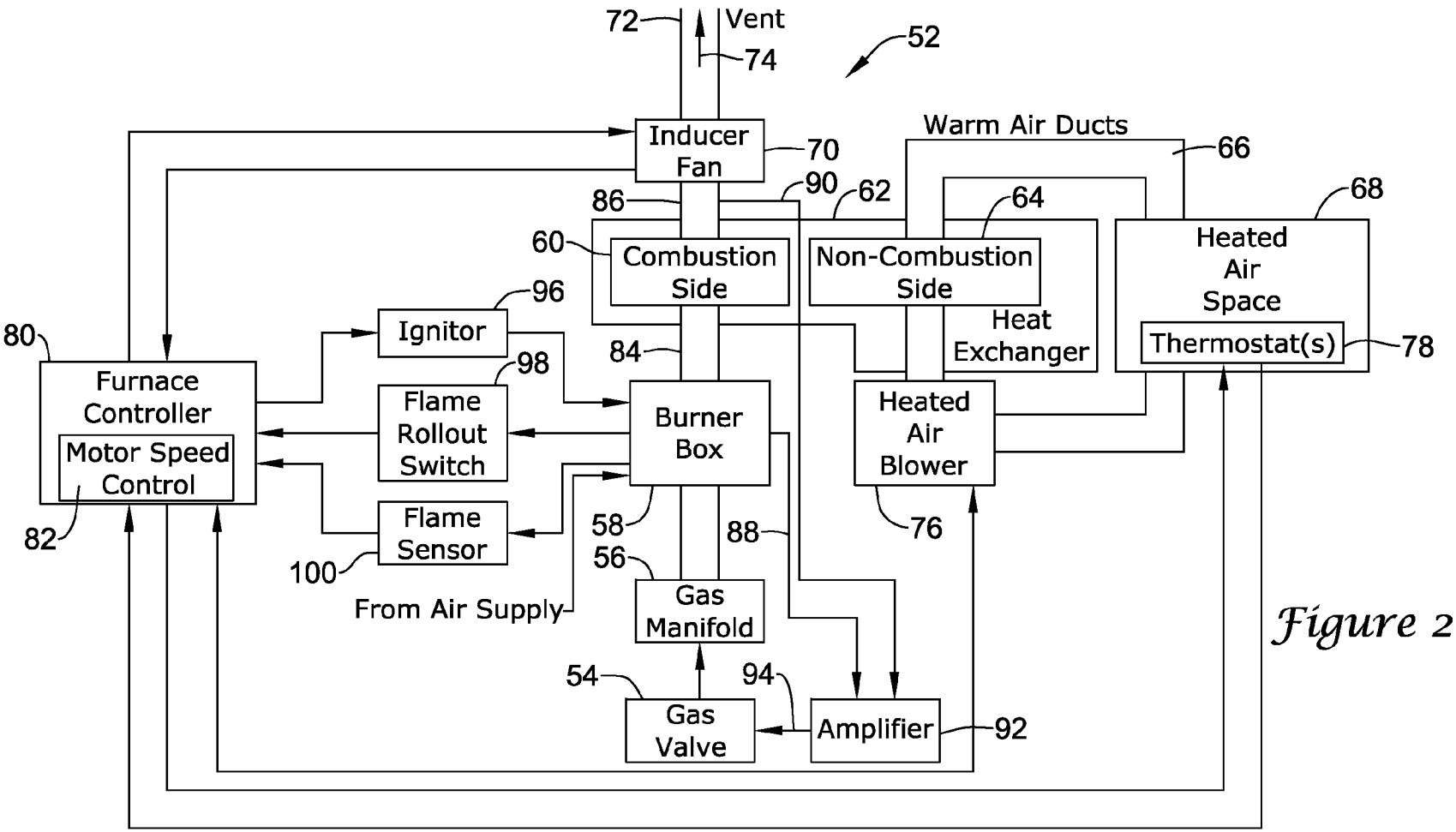
FIG. 2 is a diagrammatic view showing a warm air furnace system in accordance with an illustrative embodiment.

FIG. 2 is a diagrammatic view showing a warm air furnace (WAF) system 52 in accordance with an illustrative embodiment of the present invention. Furnace system 52 can be configured similar to furnace system 10 described in FIG. 1, including a gas valve 54, a gas manifold 56, and a burner box 58. Combusted air discharged from the burner box 58 can be fed to the combustion side 60 of a heat exchanger 62, which can be configured to transfer heat to a second side 64 thereof to provide heat to the warm air ducts 66 of a heated air space 68 such as a home or office building. An inducer fan or blower 70 coupled to the combustion side 60 of the heat exchanger 62 can be configured to draw in air through an air supply such as an intake vent or duct for use in combustion of fuel at the burner box 58. Combusted air 74 discharged from the heat exchanger 62 can be exhausted from the home or office building via an exhaust vent 72.

On the non-combustion side 64 of the heat exchanger 62, a heated air fan or blower 76 can be configured to blow heated air through a separate path in the heat exchanger 62, similar to that described above with respect to furnace system 10. In the illustrative embodiment of FIG. 2, a number of thermostats 78 located in the heated air space 68 can provide input commands to a furnace controller 80. In some embodiments, for example, one or more thermostats 78 can be utilized to program temperature set-points and/or set-point schedules in order to control the temperature within the heated air space 68. The controller 80 can be configured to provide signals back to the thermostats 78 to provide the occupant with status information on the operation of the furnace system 52. Examples of such status information can include, but is not limited to, an indication of whether the furnace is currently on or off, a fault or error message indicating if one or more of the components of the furnace needs servicing and/or maintenance, a message regarding the last time the furnace system was serviced, etc.

The furnace controller 80 can include a motor speed control unit 82 capable of varying the speed of the inducer fan 70. The inducer fan 70 can comprise a multi-speed or variable speed fan or blower capable of adjusting the combustion air flow between either a number of discrete airflow positions or variably within a range of airflow positions. In certain embodiments, for example, the inducer fan 70 can vary the combustion air flow 74 through the combustion side 60 of the furnace between an infinite number of positions within the speed range of the fan 70, allowing the furnace to draw in supply air into the burner box 58 and heat exchanger 62 at a variable rate. In some embodiments, the motor speed controller unit 82 can also vary the rate at which the heated air fan or blower 76 discharges heated air into the warm air ducts 66.

Although the furnace controller 80 depicted in FIG. 2 is equipped with an on-board motor speed control unit 82 for controlling the inducer fan 70 and/or heated air fan or blower 76, the furnace system 52 can alternatively employ a motor speed controller separate from the furnace controller 80. For example, the motor speed controller 82 could be provided as a part of the inducer fan 70, or as a stand-alone unit in communication with the furnace controller 80 and inducer fan 70.

In the illustrative embodiment of FIG. 2, the gas valve 54 is pneumatically driven via pressure signals received from the input and output sides 84,86 of the heat exchanger 62. A first pneumatic conduit 88 in fluid communication with the input side 84 of the heat exchanger 62, for example, can be used to provide a first, relatively-low pneumatic negative pressure signal for the gas valve 54. A second pneumatic conduit 90 in fluid communication with the output side 86 of the heat exchanger 62, in turn, can be used to provide a second, relatively-high pneumatic negative pressure signal for the gas valve 54. During operation, the differential pressure between the first and second pneumatic pressure signals can be used to modulate the firing rate outputted by the gas valve 54 in order to adjust the air/fuel ratio within the burner box 58.

In some embodiments, and as shown in FIG. 2, the pneumatic conduits 88,90 can be coupled to a pneumatic amplifier 92, which amplifies a differential pressure control signal 94 fed to the gas valve 54. Although an amplifier 92 can be employed to adjust the gain of the control signal 94, it should be understood that the gas valve 54 can be configured to operate without such amplifier 92, if desired. In addition, while the differential pressure control signal 94 can be developed by the pressure drop of combustion air across the heat exchanger 62, other locations such across the inducer fan 70 or at the input to the burner box 58 could also be used to provide the desired pressure signals. In some cases, modulation of the gas valve 54 can be accomplished via electrical signals received from the furnace controller 80 or from some other component, if desired.

In use, gas supplied to the gas manifold 56 and burner box 58 is automatically modulated based on the pressure differential of the combustion air across the heat exchanger 62. If, for example, the combustion air flow through the heat exchanger 62 is increased, the corresponding increase in pressure differential between the pneumatic conduits 88,90 causes the gas valve 54 to increase the firing rate in order to maintain a particular air/fuel ratio at the burner box 58. If, conversely, the combustion air flow through the heat exchanger 62 is decreased, the corresponding decrease in pressure differential between the pneumatic conduits 88,90 causes the gas valve 54 to decrease the firing rate. Typically, the gas firing rate outputted by the gas valve 54 will be linear with respect to the combustion air flow produced by operation of the inducer fan 70, although other non-linear configurations are possible.

The pressure metered fuel outputted from the gas valve 54 can be fed to the gas manifold 56, which injects the fuel into the burner box 58 for combustion. An ignition element 96 such as an AC hot surface ignition element, direct spark igniter, or other suitable igniter can then activated via the controller 80 to ignite the air/fuel mixture within the burner box 58. If desired, a flame rollout switch 98 and flame sensor 100 can be used by the controller 80 to monitor the presence of a flame within the burner box 58.

The motor speed control unit 82 can be configured to control the firing rate of the gas valve 54 at a desired value or within a range of values by adjusting the rotational speed of the inducer fan 70. The motor speed control unit 82 can include a microprocessor that calculates the air flow (CFM) based at least in part by sensing the fan speed and/or by measuring the motor voltage and/or current within the inducer fan 70. For example, in some embodiments the voltage and/or current used to operate the inducer fan motor can be measured and then correlated with a conversion factor or map stored within the motor speed control unit 82 in order to compute the combustion air flow produced by the inducer fan 70. From this calculation, the heat input to the heat exchanger 62 can then be determined, and based on the heat transfer properties of the system, can be used to determine the supply air temperature.

By sensing and computing the supply air temperature via feedback signals received from the inducer fan 70 and/or the heated air blower 76, the furnace system 52 obviates the need for additional sensors such as thermal sensors, mass flow sensors, and/or pressure sensors in the combustion air flow or non-combustion air flow path. With respect to the furnace system 10 described above with respect to FIG. 1, for example, the ability to compute the supply temperature via feedback from the inducer fan 70 and/or heated air blower 36 obviates the need for a supply air temperature sensor. In some cases, the elimination of this sensor may reduce the complexity associated with installation of the furnace system 52, and may reduce power consumption and/or the occurrence of sensor faults.

Figure 3:
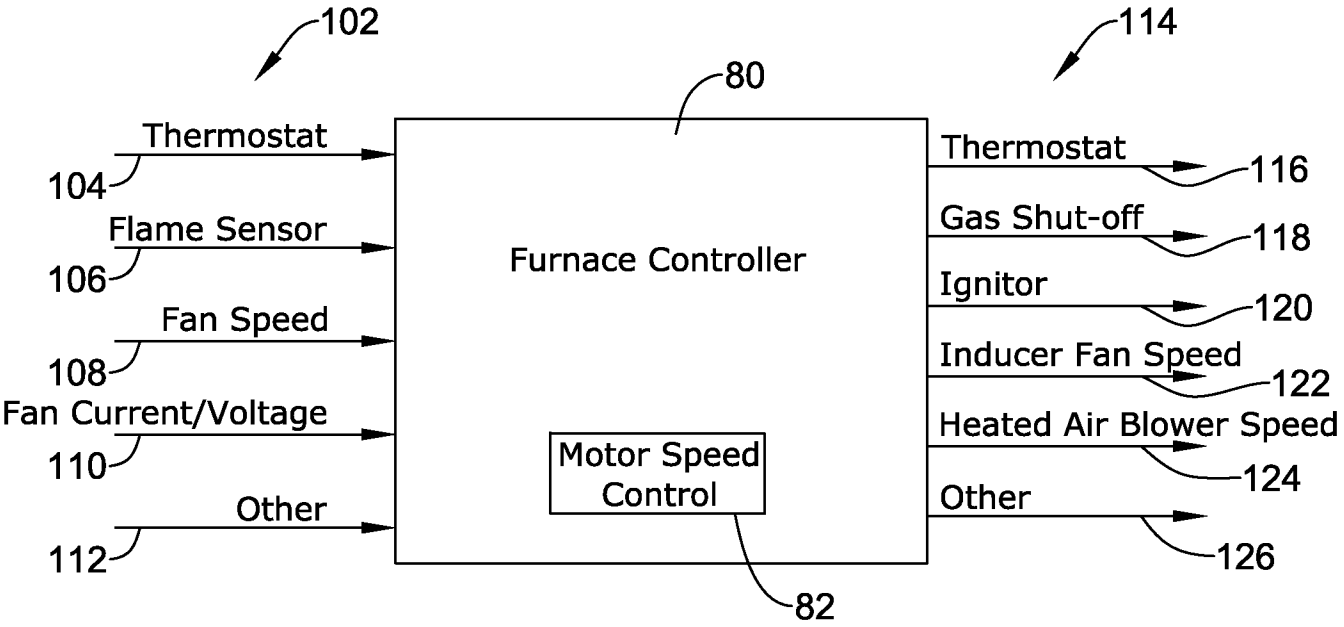
FIG. 3 is a diagrammatic view showing several illustrative inputs and outputs to the furnace controller of FIG. 2.

FIG. 3 is a diagrammatic view showing several illustrative inputs and outputs to the furnace controller 80 of FIG. 2. As shown in FIG. 3, the furnace controller 80 can be configured to receive as inputs 102 a thermostat signal 104, a flame sensor signal 106, a fan speed signal 108, and a fan voltage/current signal 110. The thermostat signal 104 can include set-points values received from the thermostats as well as other status and operational information. When a flame sensor is employed, the flame sensor signal 106 can be fed to the controller 80 to permit the controller 80 to shut-off the supply of gas fed to the burner box in case a flame is not present or is insufficient. For example, an off signal received from the flame sensor can cause the controller 80 to shut-off the supply of gas fed to the gas valve until at such point the ignition element can be configured to reestablish ignition.

The fan speed signal 108 can be utilized by the on-board motor speed control unit 82 compute the temperature of the supply air fed to the burner box based on the combustion air flow, as discussed above. The fan speed signal 108 can be sensed, for example, via a sensor (e.g. a Hall effect sensor, reed switch, magnetic sensor, optical sensor, etc.) in order to compute the combustion air flow produced by the inducer fan or blower wheel. In some embodiments, for example, rotational speed of the inducer fan can be determined via a sensor or switch located adjacent the blower wheel used in some fan or blower configurations. The manner in which the speed signal 108 is obtained will differ, however, depending on the type of fan configuration employed. From the fan speed signal 108, the controller 80 can be configured to compute the supply air temperature from the heat transfer properties of the heat exchanger.

A fan voltage/current signal 110 can also be received in addition to, or in lieu of, the fan speed signal 108 for computing the combustion air flow through the combustion side of the furnace system. In some embodiments, for example, the fan voltage/current signal 110 can be determined by directly measuring the power drop across a resistive element (e.g. a high-precision resistor) coupled to the fan motor or by other methods such as via a resistive bridge circuit. As with the fan speed signal 108, the fan voltage/current signal 110 can be used to compute the heat provided to the heat exchanger, which, in turn, can be used to compute the supply air temperature.

As indicated generally by reference number 112, the furnace controller 80 can be configured to receive one or more other signals for controlling other aspects of the furnace system. Examples of other types of signals 112 can include actuator signals from other furnace components such as any dampers or shut-off valves as well as power signals from the other furnace components. It should be understood that the types of signals fed to the controller 80 will typically depend on the type of gas-power appliance being controlled.

The outputs 114 of the controller 80 can include a thermostat signal 116 for communicating with each thermostat, a gas-shut-off signal 118 for controlling the supply of gas to the gas valve, and an igniter signal 120 for ignition of fuel within the burner box. An inducer fan speed signal 122 outputted to the inducer fan can be provided to control the speed of the fan to either increase or decrease the combustion air flow. A heated air blower speed signal 124, in turn, can be outputted to the heated air fan or blower to control the operational times and/or speed of the heated air discharged into the warm air ducts. As indicated generally by reference number 126, the controller 80 can also be configured to output one or more other signals, if desired.

Figure 4:
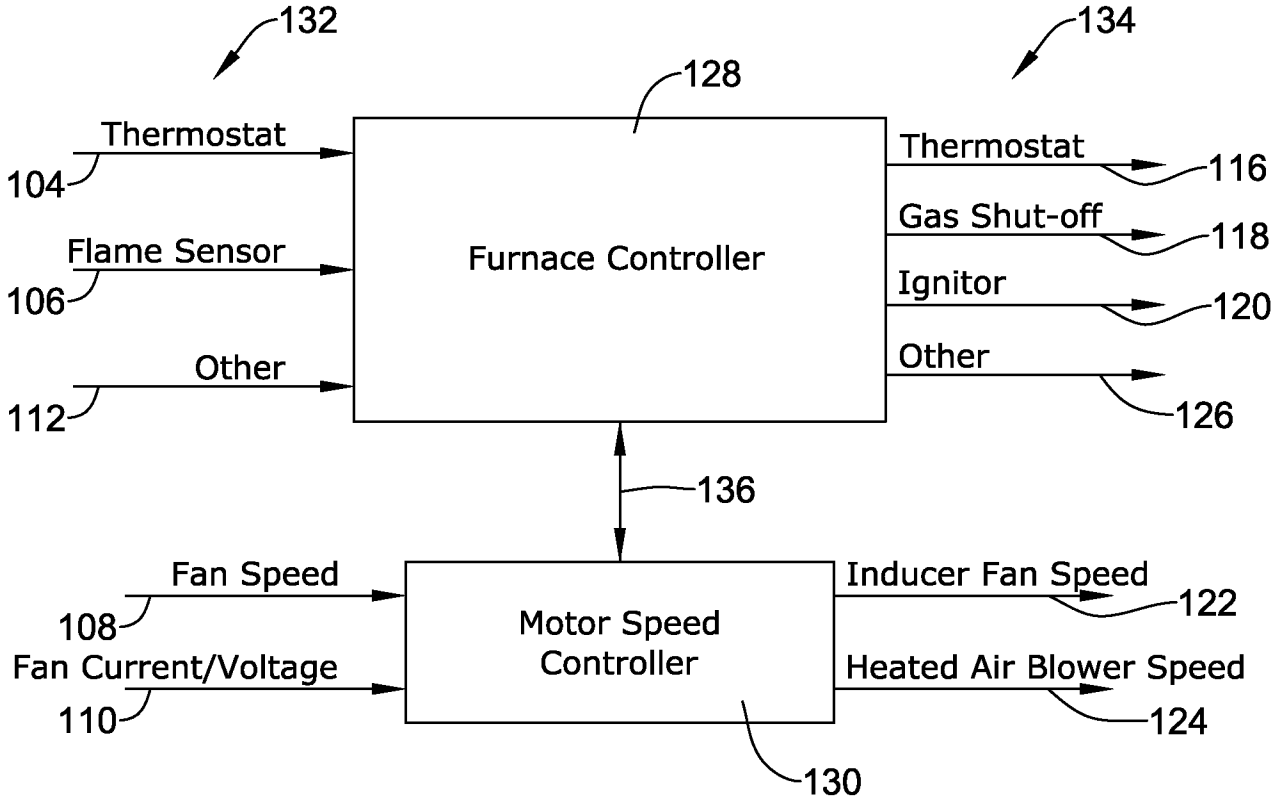
FIG. 4 is a diagrammatic view showing several illustrative inputs and outputs to an alternative furnace system having a separate furnace controller and motor speed control unit.

FIG. 4 is a diagrammatic view showing several illustrative inputs and outputs to an alternative furnace system having a separate furnace controller 128 and a motor speed control unit 130. The inputs 132 to the furnace controller 128 can be similar to that discussed above with respect to FIG. 3, including the thermostat signal 104, the flame sensor signal 106, as well as other signals 112. The outputs 134 to the furnace controller 128, in turn, can include the thermostat signal 116, the gas shut-off signal 118, the igniter signal 120, as well as other signals 126.

As illustrated diagrammatically in FIG. 4, the motor speed control unit 130 can comprise a separate unit from the furnace controller 128. In certain embodiments, for example, the motor speed control unit 130 can be a part of the inducer fan, or a separate component in communication with the furnace controller 128 and inducer fan. The motor speed control unit 130 can communicate with the furnace controller 128 via a communications bus 136. In some embodiments, for example, the motor speed control unit 130 can be configured to communicate with the furnace controller 128 over an ENVIRACOM platform developed by Honeywell, Inc. It should be understood, however, that the motor speed control unit 130 can be configured to communicate using a wide range of other platforms and/or standards, as desired.

Figure 5:
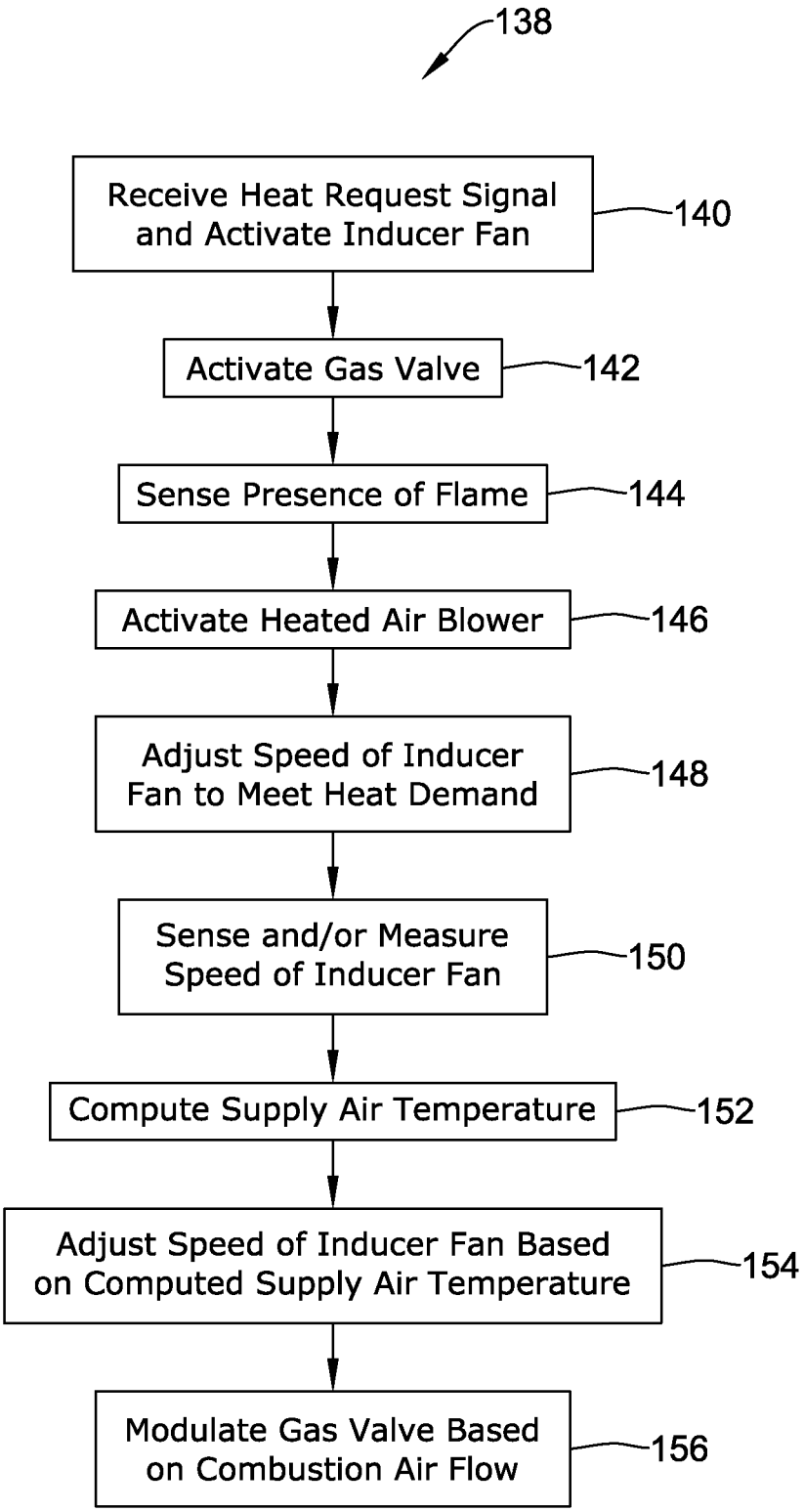
FIG. 5 is a flow chart showing an illustrative method of operating the furnace system of FIG. 2.

FIG. 5 is a flow chart showing an illustrative method 138 of operating the warm-air furnace system of FIG. 2. Beginning at block 140, a heat request signal from one or more of the thermostats 78 (e.g. from a user adjusting the temperature setpoint upwardly) can cause the furnace controller 80 to activate the inducer fan 70, causing the fan 70 to discharge combustion air through the exhaust vent 72. The initial speed of the inducer fan 70 can be set based on the inputted temperature set-point received at the thermostat 78, or can be predetermined via software and/or hardware within the motor speed control unit 82. During this period, the ignition element 96 can be heated to a temperature sufficient for ignition of the burner elements within the burner box 58. In those gas-fired appliances employing an AC hot surface ignition element, for example, an AC line voltage of either 120 VAC or 24 VAC can be applied to heat the element to a temperature sufficient to cause ignition.

Once the inducer fan 70 is at its proper ignition speed and the ignition element 96 is at the proper ignition temperature, the controller 80 may then power the gas valve 54, as indicated generally by block 142, forcing metered fuel into the burner box 58 for combustion. Upon activation, the ignition element 96 may ignite the fuel causing a flame to develop, which can then be sensed via the flame sensor 100, as indicated generally by block 144. After the heat exchanger 62 warms for a predetermined period of time (e.g. 15 to 30 seconds), the heated air fan or blower 76 can then be activated to direct cold air across the heat exchanger 62 and into the warm air ducts 66, as indicated generally by block 146.

Once ignition is proven, the ignition element 96 can then be deactivated and the controller 80 tasked to adjust the speed of the inducer fan 70 to meet the heat demand set-points received by the thermostats 78, as indicated generally by block 148. The furnace controller 80 can be configured to sense and/or measure the speed of the inducer fan 70, as indicated generally by block 150. Sensing of the inducer fan speed can be accomplished, for example, with a sensor, switch, or other suitable means for sensing rotation of the blower wheel or other component of the inducer fan 70.

Figure 6:
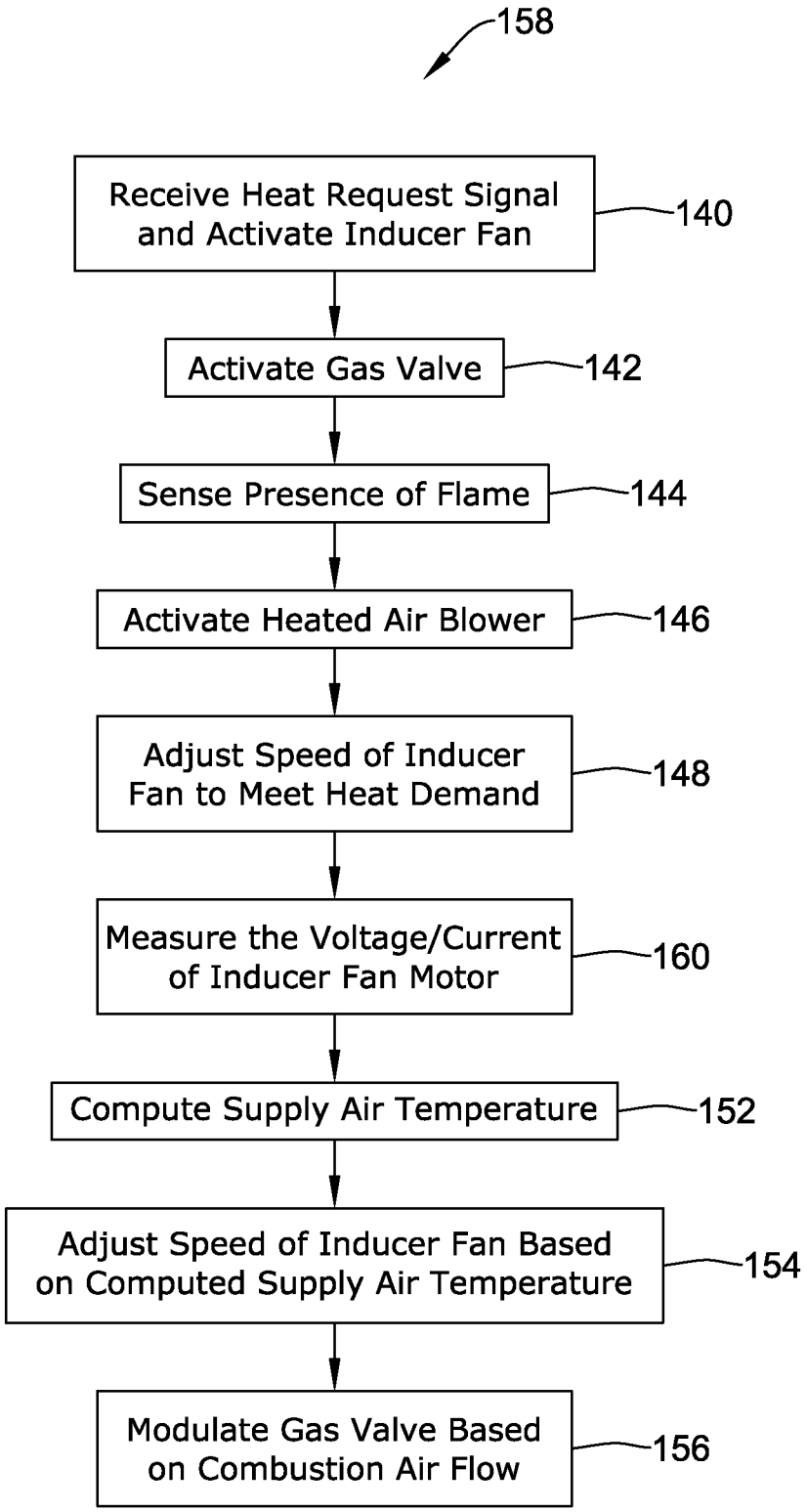
FIG. 6 is a flow chart showing another illustrative method of operating the furnace system of FIG. 2.

In an alternative method 158 depicted in FIG. 6, the furnace controller 80 can be configured to sense the voltage and/or current within the inducer fan motor, which can also be used by the controller 80 to compute the supply air temperature to the burner box 58. Method 158 may be similar to that of FIG. 5, with like steps labeled in like fashion in the drawings. As indicated generally by block 160, however, the furnace controller 80 can be configured to measure the voltage/current of the inducer fan motor in order to determine the combustion air flow. The measurement of the voltage and/or current within the inducer motor can be accomplished, for example, by measuring the voltage or current drop across a reference resistor, or using an electrical bridge circuit such as a Wheatstone bridge.

From the sensed speed at block 150 in FIG. 5, or from voltage and/or current measurements made at block 160 in FIG. 6, the furnace controller 80 can then calculate the supply air temperature to the burner box 58, as indicated generally by block 152. Calculation of the supply air temperature can be accomplished, for example, using conversion factors or maps based at least in part on the heat transfer characteristics of the heat exchanger 62, the air flow characteristics of the inducer fan 70, and the dimensions of the combustion air flow conduit.

Once the supply air temperature has been computed at block 152, the furnace controller 80 may next adjust the speed of the inducer fan 70 in order to achieve the temperature set-point received by the thermostats 78, as indicated generally by block 154. If, for example, the controller 80 determines that an increase in air flow is necessary based on the calculated temperature of the supply air fed to the heat exchanger 62, the controller 80 can increase the rotational speed of the inducer fan 70. Conversely, if the controller 80 determines that a decrease in air flow is necessary based on the calculated supply air temperature, the controller 80 can decrease the rotational speed of the inducer fan 70.

As the controller 80 adjusts the speed of the inducer fan 70 either upwardly or downwardly depending on the heating demand, the combustion air flow will likewise fluctuate causing a change in air pressure across the heat exchanger 62. This change in pressure can then be sensed by the gas valve 54 via the pneumatic conduits 88,90. As indicated generally by block 156, the gas valve 54 can then modulate the fuel fed to the burner box 58 based on these pressure signals. The process of sensing and/or measuring the speed of the inducer fan 70 or the voltage/current of the inducer fan motor, computing the supply air temperature, and then adjusting the speed of the inducer fan 70 based on the calculated supply air temperature in order to modulate the gas valve can then be repeated, as necessary, to achieve or maintain the desired temperature set-point.

Figure 7:
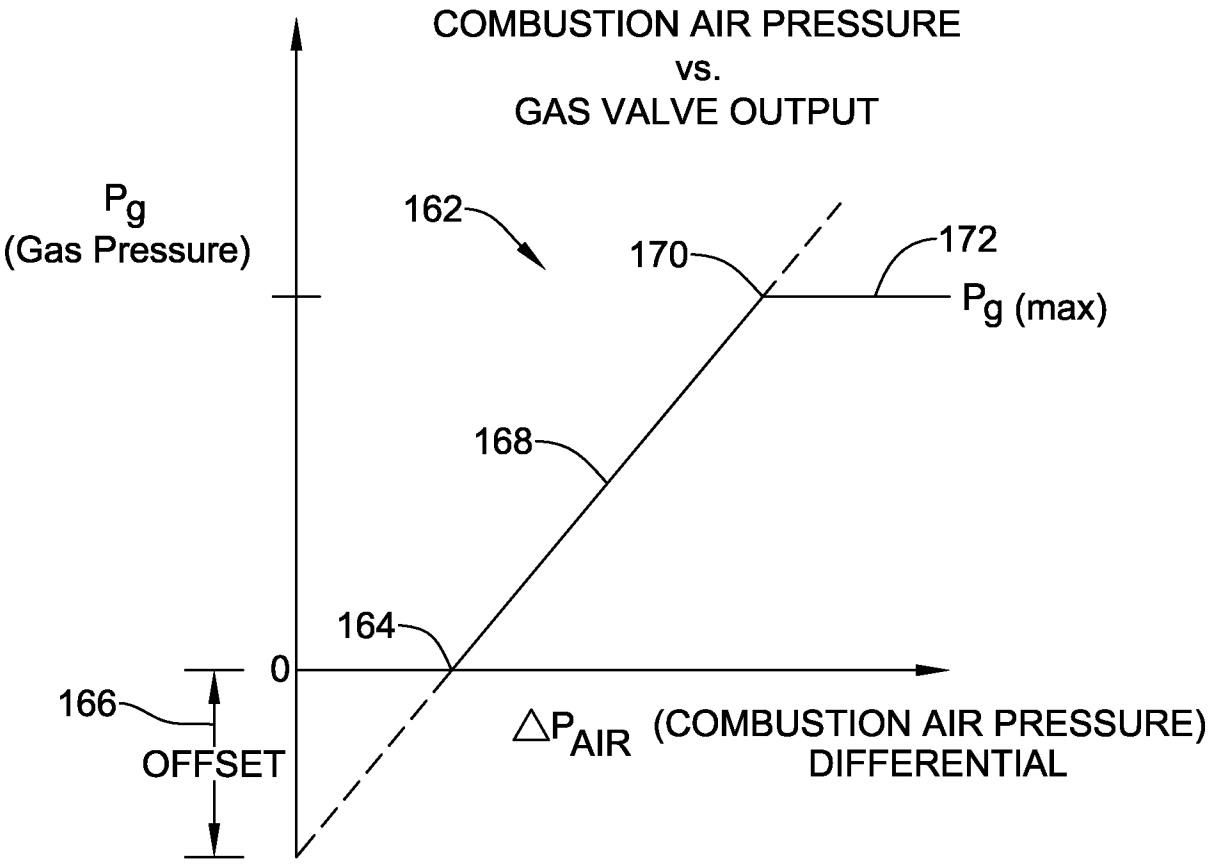
FIG. 7 is a graph showing the change in combustion air pressure as a function of gas valve output pressure for the illustrative furnace system of FIG. 2.

FIG. 7 is a graph 162 showing the change in combustion air pressure $\Delta P_{air}$ as a function of gas valve output pressure $P_g$ for the illustrative furnace system 52 of FIG. 2. Beginning at point 164, when a sufficient pressure differential $\Delta P_{air}$ between the pneumatic conduits 88,90 is sensed, the gas valve 54 can be configured to open and output gas pressure to the burner box 58. In some embodiments, the pressure differential $\Delta P_{air}$ at which the gas valve 54 opens can be adjusted by a negative offset 166 so that the gas valve 54 is not opened until a minimum amount of combustion air flow is present. Such offset, for example, can be utilized to prevent the gas valve 54 from opening unless a sufficient flow of combustion air is present at the burner box 58.

Once the gas valve 54 is initially opened at point 164, the gas pressure $P_g$ outputted by the gas valve 54 increases in proportion to the pressure change $\Delta P_{air}$ produced by the pressure signals received from the pneumatic conduits 88,90, as illustrated generally by ramp 168. In those embodiments employing an amplifier 92, the slope of the ramp 168 will typically be greater due to the amplification of the pressure differential $\Delta P_{air}$ fed to the gas valve 54.

In some embodiments, the gas valve 54 can be equipped with a high-fire pressure regulator in order to limit the gas pressure outputted from the gas valve 54 once it reaches a particular point 170 along the ramp 124. When a high-fire pressure regulator is employed, and as illustrated generally by line 172, the gas pressure $P_g$ outputted by the gas valve 54 will not exceed a maximum gas pressure $P_{g(max)}$, thus preventing over-combustion at the burner box 58.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention.

What is claimed is:

1. A method of controlling a gas-fired appliance, wherein the gas-fired appliance includes a burner unit, a heat exchanger, a gas valve, a multi or variable speed inducer fan that is configured to produce a combustion air flow through the burner unit and the heat exchanger, and a heated air blower configured to force air through the heat exchanger and to one or more warm air ducts, the method comprising:

a) setting the multi or variable speed inducer fan to a first fan speed to provide a combustion air flow through the burner unit;

b) delivering an amount of fuel to the burner unit via the gas valve to form a combustion air/fuel mixture in the burner unit, wherein the amount of fuel that is delivered to the burner unit is dependent on the combustion air flow;

c) igniting the combustion air/fuel mixture within the burner unit, if not already ignited;

d) calculating a measure that is representative of a temperature of a predetermined air flow of the gas-fired appliance based, at least in part, on the first fan speed;

e) adjusting the speed of the inducer fan or blower to an adjusted fan speed, wherein the adjusted fan speed is based, at least in part, on the calculated measure that is representative of the temperature of the predetermined air flow, resulting in an adjusted combustion air flow through the burner unit; and f) repeating steps b)-e) using the adjusted combustion air flow through the burner unit.

2. The method of claim 1, wherein the amount of fuel that is delivered to the burner unit is dependent on a pressure differential across the burner unit and/or heat exchanger.

3. The method of claim 2, further comprising sensing a change in air pressure across the burner unit and/or heat exchanger, and adjusting the amount of fuel provided to the burner unit in response to the sensed change in air pressure.

4. The method of claim 1, wherein the amount of fuel that is delivered to the burner unit is dependent on a measured, a sensed or a calculated combustion air flow produced by the multi or variable speed inducer fan.

5. The method of claim 4, wherein the measured, sensed or calculated combustion air flow produced by the multi or variable speed inducer fan is determined, at least in part, using an air flow sensor.

6. The method of claim 4, wherein the measured, sensed or calculated combustion air flow produced by the multi or variable speed inducer fan is determined, at least in part, using a measured voltage or current of the multi or variable speed inducer fan.

7. The method of claim 4, wherein the measured, sensed or calculated combustion air flow produced by the multi or variable speed inducer fan is determined, at least in part, using a speed sensor for the multi or variable speed inducer fan.

8. The method of claim 1, wherein adjusting the speed of the inducer fan or blower to another fan speed is accomplished with a motor speed control unit.

9. A method of controlling a gas-fired appliance, wherein the gas-fired appliance includes a burner unit, a heat exchanger, a gas valve, a multi or variable speed inducer fan that is configured to produce a combustion air flow through the burner unit and the heat exchanger, and a heated air blower configured to force air through the heat exchanger and to one or more warm air ducts, the method comprising:

a) receiving a heat demand request from one or more thermostats;

b) activating the multi or variable speed inducer fan to provide a combustion air flow through the burner unit, if not already activated;

c) sensing and/or measuring an inducer fan speed of the multi or variable speed inducer fan;

d) delivering an amount of fuel to the burner unit via the gas valve to form a combustion air/fuel mixture in the burner unit, wherein the amount of fuel that is delivered to the burner unit is related to the sensed or measured inducer fan speed of the multi or variable speed inducer fan;

e) receiving an updated heat demand request from the one or more thermostats;

f) adjusting the inducer fan speed based, at least in part, on the updated heat demand request received from the one or more thermostats;

g) sensing and/or measuring an updated inducer fan speed of the multi or variable speed inducer fan;

h) calculating a measure that is representative of a temperature of a predetermined air flow of the gas-fired appliance based, at least in part, on the updated inducer fan speed;

i) adjusting the updated inducer fan speed based, at least in part, on the calculated measure that is representative of the temperature of the predetermined air flow; and j) delivering an updated amount of fuel to the burner unit via the gas valve to form an updated combustion air/fuel mixture in the burner unit, wherein the updated amount of fuel that is delivered to the burner unit is related to the updated inducer fan speed of the multi or variable speed inducer fan.

10. The method of claim 9, further comprising igniting the combustion air/fuel mixture within the burner unit.

11. The method of claim 9, wherein sensing and/or measuring the inducer fan speed comprises sensing a voltage and/or a current within an inducer fan motor.

12. The method of claim 9, wherein sensing and/or measuring the inducer fan speed comprises sensing a rotation of an inducer fan motor.

13. A controller for controlling a gas-fired appliance, wherein the gas-fired appliance includes a burner unit, a heat exchanger, a gas valve, a multi or variable speed inducer fan that is configured to produce a combustion air flow through the burner unit and the heat exchanger, and a heated air blower configured to force air through the heat exchanger and to one or more warm air ducts, the controller programmed to:

a) receive a heat demand signal from one or more thermostats;

b) send a signal to activate the inducer fan to provide a combustion air flow to the burner unit;

c) determine a measure related to a mass air flow of the inducer fan;

d) send a signal to provide an amount of fuel to the burner unit based, at least in part, on the measure related to the mass air flow of the inducer fan;

e) send a signal to adjust a speed of the inducer fan based at least in part on the heat demand signal received from the one or more thermostats;

f) determine a measure related to an updated mass air flow of the inducer fan;

g) send a signal to modulate the amount of fuel provided to the burner unit based on the measure related to the updated mass air flow of the inducer fan;

h) calculate a measure that is representative of a temperature of a predetermined air flow of the gas-fired appliance based, at least in part, on the speed of the inducer fan; and i) send a signal to adjust the speed of the inducer fan based, at least in part, on the calculated measure that is representative of the temperature of the predetermined air flow.

14. The controller of claim 13 wherein the predetermined air flow corresponds to an air flow downstream of the burner unit.

15. The controller of claim 13, wherein the controller is programmed to send a signal to adjust a speed of the inducer fan based, at least in part, on the calculated measure that is representative of the temperature of the predetermined air flow and the heat demand signal.

16. The controller of claim 13, wherein the measure related to the mass air flow of the inducer fan is determined based, at least in part, on the speed of the of the inducer fan.

17. The controller of claim 13, wherein the measure related to the mass air flow of the inducer fan is determined based, at least in part, on an output of an air flow sensor.

18. The controller of claim 13, wherein the measure related to the mass air flow of the inducer fan is determined based, at least in part, on a pressure differential across the burner unit and/or heat exchanger.

* * * * *